United States Patent [19]

Nakazato et al.

[11] 4,035,987

[45] July 19, 1977

[54] APPARATUS FOR SEALING THE HEADS OF CONTAINERS

[75] Inventors: Tetsuo Nakazato, Sakai; Shunji Kamon, Kawanishi; Koichi Tokuda, Takarazuka; Keisuke Honma, Itami, all of Japan

[73] Assignee: Sumitomo Bakelite Company, Limited, Tokyo, Japan

[21] Appl. No.: 651,816

[22] Filed: Jan. 23, 1976

[30] Foreign Application Priority Data

Jan. 30, 1975 Japan ..... 50-13237

[51] Int. Cl.[2] ..... B65B 61/18; B65B 7/28; B67B 3/04

[52] U.S. Cl. ..... 53/133; 53/298; 53/329

[58] Field of Search ..... 53/329, 133, 296, 297, 53/298, 30 S, 373, 379, 39, 42

[56] References Cited

U.S. PATENT DOCUMENTS

| | | | |
|---|---|---|---|
| 3,067,653 | 12/1962 | Lesser et al. | 53/30 S X |
| 3,112,587 | 12/1963 | Anderson et al. | 53/329 UX |
| 3,354,604 | 11/1967 | Amberg et al. | 53/42 |
| 3,460,317 | 8/1969 | Carter et al. | 53/329 |
| 3,491,510 | 1/1970 | Sternau | 53/42 |
| 3,509,682 | 5/1970 | Logemann | 53/298 X |
| 3,590,554 | 7/1971 | Carter | 53/329 X |
| 3,849,971 | 11/1974 | Granseus et al. | 53/329 |
| 3,877,200 | 4/1975 | Feldman | 53/329 X |
| 3,884,017 | 5/1975 | Butcher | 53/296 |

*Primary Examiner*—Othell M. Simpson
*Assistant Examiner*—Horace M. Culver
*Attorney, Agent, or Firm*—Toren, McGeady and Stanger

[57] ABSTRACT

The apparatus for sealing the heads of containers comprises means for cutting out from a continuous plastic film a sealing sheet, means for folding the peripheral portion of the sealing sheet toward the outer peripheral surface of the container and means for applying hot air against the folded peripheral portion of the sheet to heat-shrink the same.

6 Claims, 14 Drawing Figures

APPARATUS FOR SEALING THE HEADS OF CONTAINERS

This invention relates to an apparatus for sealing the heads of containers, and more particularly to an apparatus for cutting out sealing sheets from a biaxially stretched (oriented) continuous plastic film (hereinafter referred to briefly as "film" throughout the specification and claims) and heat-shrinking the sheets to seal the heads of containers with the sheets in the form of a cap. The apparatus of this invention is particularly suitable for sealing containers such as bottles, cans and cups containing foods, alcoholic or other beverages, drugs, etc.

Seals of such type for the heads of containers already known involve problems in cutting out the sealing sheet from film material. Conventional sealing sheets are cut out by a cutting tool of the punch type or by melting with irradiation of rays of heat. In the former case, the cutting tool is liable to rupture the film unless the edge of the tool comes into uniform contact with the film, failing to cut out a sheet which is applicable to the head of container for sealing. On the other hand, the sealing sheet obtained in the latter case wrinkles or creases due to the shrinkage of its edge resulting from the melting of the sealing sheet, making it difficult to satisfactorily seal the container in the form of a cap. Moreover, the sealing sheet cut out from the film by either of the conventional methods has a shape which is dissimilar to the shape of the head of the container to be sealed as the head is seen in plan, the shape of the former being square and that of the latter being usually circular, with the resulting disadvantage that the sealing sheet is not effectively shrinkable around the container head when subjected to heat.

Accordingly, an object of this invention is to overcome the drawbacks of the prior art and to providean apparatus for cutting out sealing sheets from a film free of rupture and creasing and sealing the heads of containers with the sheets in the form of a cap.

Another object of this invention is to provide an apparatus which is capable of effectively shrinking sealing sheets at the specified portion thereof to satisfactorily seal containers with the sheets in the form of a cap.

This invention provides an apparatus for sealing the heads of containers comprising:

means for positioning in a specified place the container to be sealed, means for drawing out a continuous film by predetermined length to a position immediately above the head of the container positioned in the specified place, means for cutting out from the continuous film a sealing sheet which has a shape substantially similar to the shape in plan view of the head of container to be sealed and which is larger in size than the head of container, the cutting-out means including a vertically movable annular punch and a die cooperative therewith and being disposed over the container positioned in the specified place, means for clamping the film along the portion thereof to be cut out as the sealing sheet while the annular punch is operated, said clamping means including a vertically movable upper member which is disposed over said positioning means and is positioned concentrically with said cutting-out means, and a stationary lower member positioned at a specified place, holding means positionable over the head of the container to press the sealing sheet against the head during sealing operation after the sheet has been cut out from the film, said holding means being disposed over said positioning means and vertically movable, means for folding the peripheral portion of the sheet to be heat-shrunk toward the outer peripheral surface of the container while the sheet is being pressed against the head, said folding means being disposed over said positioning means coaxially therewith and vertically movable, means for applying hot air against the folded peripheral portion of the sheet, said hot air applying means being disposed over said positioning means concentrically with said clamping means and said cutting-out means and being vertically movable, and the annualar punch being mounted on an air outlet defining member included in the hot air applying means, means for removing the film scrap which remains after the sealing sheet has been cut out, said drawing-out means being adapted to draw out the film to a specified position before the sealing sheet is cut from the film; said cutting-out means being adapted to cut out the sealing sheet from the film clamped by said clamping means; said clamping means being allowed to release the film which will be drawn out again after the sealing sheet has been cut out; said holding means, folding means and hot air applying means being resettable in respective predetermined positions after the container head has been sealed; and said removing means being adapted to remove the film scrap remaining after the container head has been sealed.

According to this invention, a continuous film is clamped, before cutting out, along the portion to be cut out as a sealing sheet. Consequently, the film is held against displacement to enable the annular punch to effectively cut out the sealing sheet from the film in cooperation with the die when the punch is thereafter operated. Moreover, the annular punch of this invention, which is attached to a hot air outlet defining member and is thereby adapted to be heated, also acts to cut the film by melting unlike a simple cutting blade and therefore will not rupture the film even if the blade of the punch fails to come into uniform contact with the film. Because the film is melted and cut by the blade of the annular punch after having been clamped, the film can be cut sharp without creasing or wrinkling. Thus the invention ensures that sealing sheets will be cut out from the film accurately in shape and dimensions.

With a preferred embodiment of this invention, the annular punch has a blade comprising a plurality of inverted V-shaped edges arranged throughout the entire circumference of the punch and each having an equal circumferential length. The edges of the blade are serrated. This punch can cut out sealing sheets more effectively than the conventional punch of simple annular blade type.

The container to be sealed is positioned below the holding means in opposing relation thereto and in close vicinity to the clamping means. The container may be brought to the specified position on the present apparatus by a suitable mechanical system such as conveyor or by a manual operation.

The sealing sheet cut out from the film is placed over the head of the container brought to the specified position. This can be assured by cutting out the sheet after the container has been so positioned. The sealing sheet on the container is then pressed against the container head by the holding means subsequently actuated. The sealing sheet has such predetermined dimensions that when it is held in position its peripheral portion projects outward from the head of the container. The sealing sheet is held against the head during the following sealing operation.

The portion of the sheet projecting outward from the container head is folded toward the outer peripheral surface of the container head by the folding means.

Subsequently hot air is forced out against the folded peripheral portion of the sheet to heat-shrink the peripheral portion, whereby the container head is sealed with the sheet in the form of a cap. The means for applying hot air according to this invention is in the form of an annular nozzle or outlet to be positioned around the folded peripheral portion of the sealing sheet and is preferably such that hot air will be forced out in the form of a swirling current around the peripheral portion of the sheet. This assures uniform application of the hot air to the folded portion of the sheet, leading to effective heat shrinkage of the folded portion and accordingly to effective sealing of the container with a cap-shaped seal. During the application of heat, the other portion of the sheet covering the top surface of the container is covered by the hold means, which prevents that portion from exposure to the hot air and therefore from shrinking. Because the portion of the sheet projecting from the container head has been folded toward the outer peripheral surface of the container head and also because the sheet has a shape substantially similar to the shape of the container head as it is seen in plan, the projecting portion of the sheet effectively shrinks along the outer periphery of the container head. According to this invention, therefore, the container head can be advantageously sealed with the sheet in the form of a cap. The shape of the container head may be any shapes generally known such as circular, square and like shapes. The annular shape of the punch may be changed in accordance with the shape of the container head to be sealed.

Preferably the present apparatus may further include means for cooling the holding means. The cooling means cools the portion of the sheet held in contact with the holding means, permitting the folded projecting portion of the sheet only to shrink and leading to more effective sealing. Water or air is usable for the cooling means, and satisfactory results are attainable with such cooling medium used at room temperature.

For use as an air source for the hot air, compressed air is more advantageous than the air supplied by a blower. With the use of compressed air, air can be applied at a high pressure sufficient to promote folding of the projection of the sheet. For this purpose, the compressed air may have a pressure of at least 1 kg/cm$^2$ gauge, preferably 1.5 to 4 kg/cm$^2$ gauge.

When desired, the clamping means of this invention may be provided with cooling means to preclude unnecessary shrinkage of the film which would result from the heating of the clamping means by the hot air. The type of the cooling means and the temperature of the cooling means may be the same as those used for the holding means.

Further when desired, the holding means may be temporarily heated after the folded projection of the sheet has been heat-shrunk to slightly heat the other portion of the sheet in contact with the lower surface of the holding means to such an extent that the portion will be rendered free of any slack.

When required, the assembly or the apparatus head comprising the cutting-out means, clamping means, holding means, folding means and hot air applying means can be mounted on the frame of the apparatus so as to be vertically shiftable in conformity with the height of the containers to be sealed.

The apparatus of this invention may include one head or a plurality of like heads as arranged transversely of the frame of the apparatus.

Films usuable in this invention are those known in the technical fild wherein a container head is sealed by heat-shrinking a sealing sheet cut out from a biaxially stretched continuous plastic film. Examples of the films are the films made from vinyl chloride, polypropylene, ABS, styrol, modified styrol, methyl methacrylate-butadiene-styrene terpolymer and polyethylene resins.

Containers to be sealed by the present apparatus may be any of metal, plastics, paper, glass and clay containers.

The containers to be sealed by the apparatus of this invention are those the heads of which can be sealed with sealing sheets. Generally, such containers include, for example, those containing custard pudding, ice cream, snacks, milk, jam mayonnaise, cosmetics and medicines, and cans containing juices and beer.

This invention will be described below in greater detail with reference to the accompanying drawings showing a preferred embodiment of the invention, in which.

Figure 3:
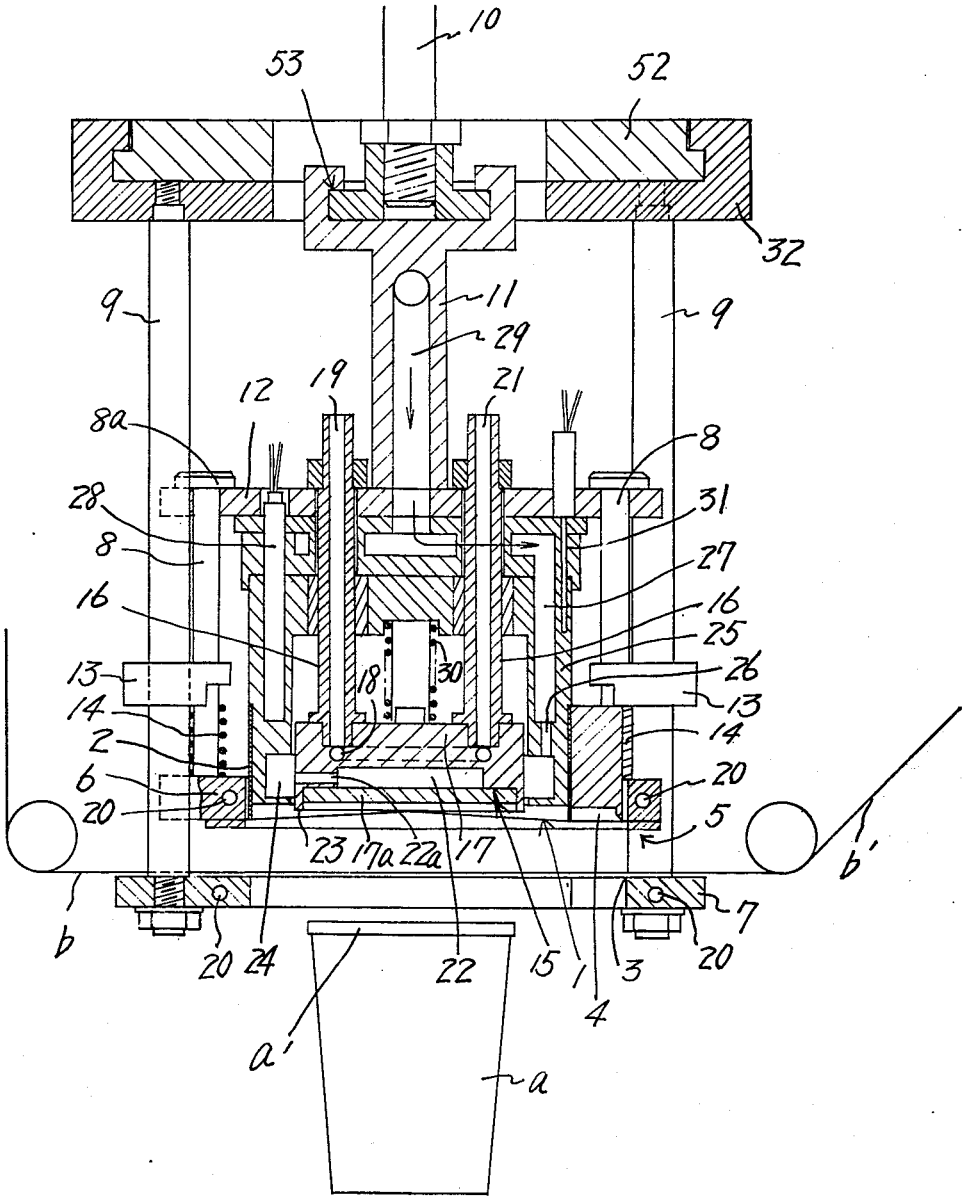
FIG. 3 is an enlarged front view in vertical section showing the head portion of the embodiment.
Figure 4:
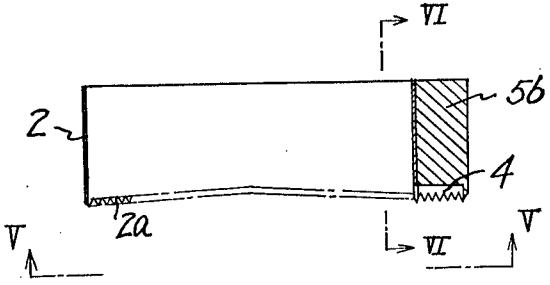
Figure 5:
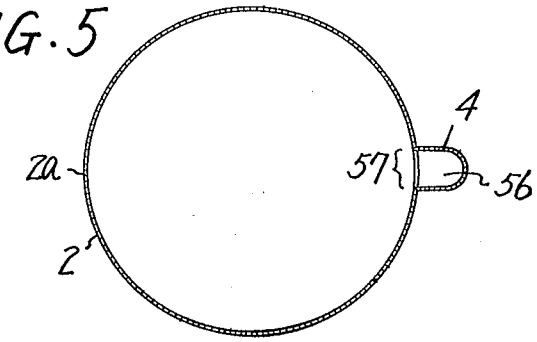
Figure 6:
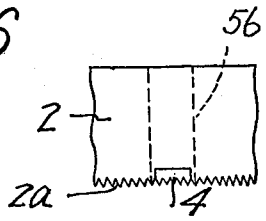
Figure 3A:
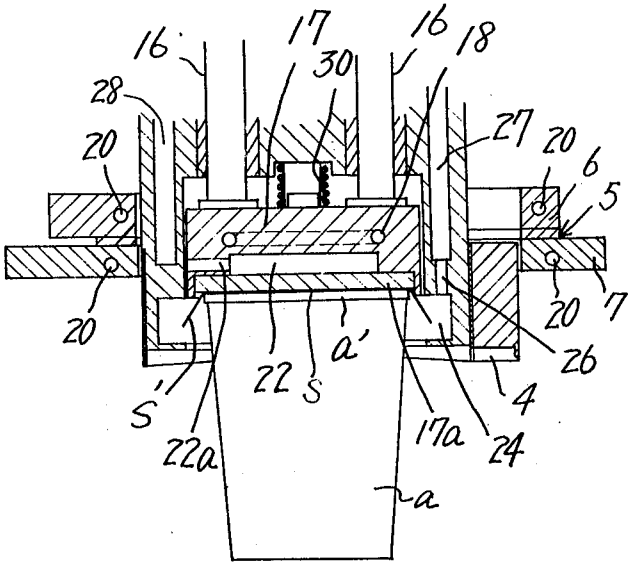
Figure 7:
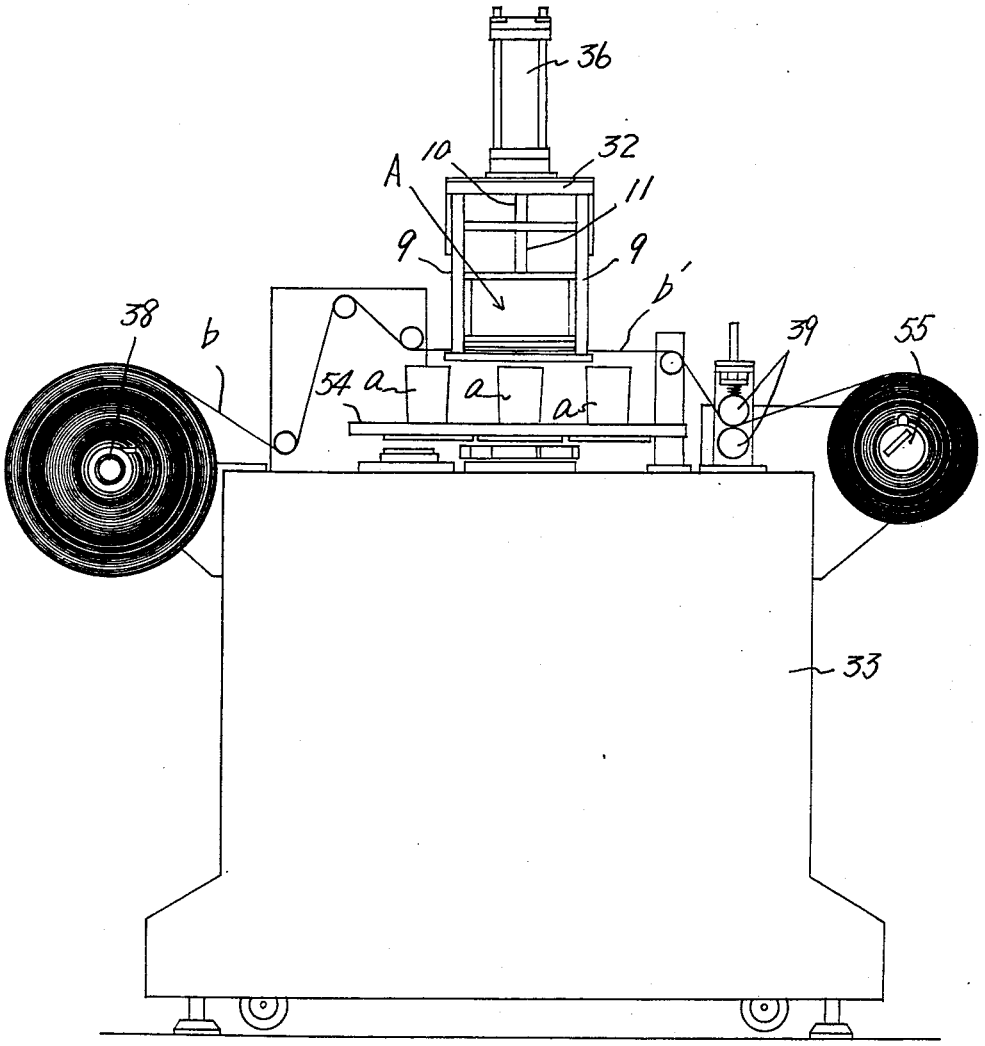
Figure 8:
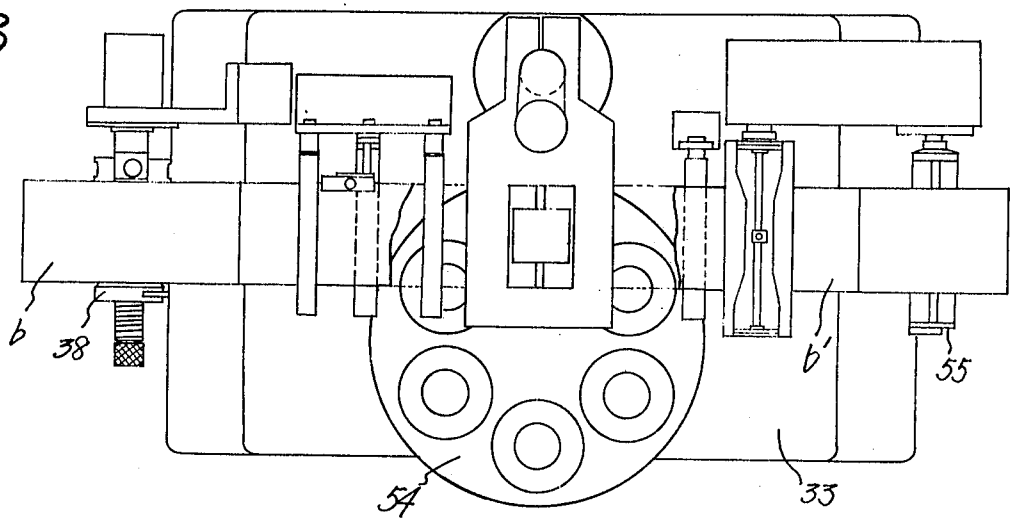
Figure 9:
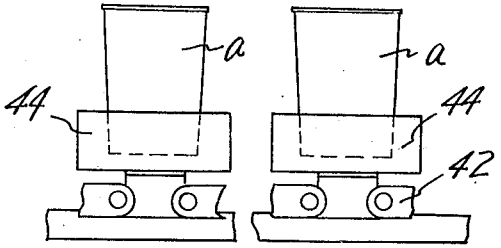
Figure 10:
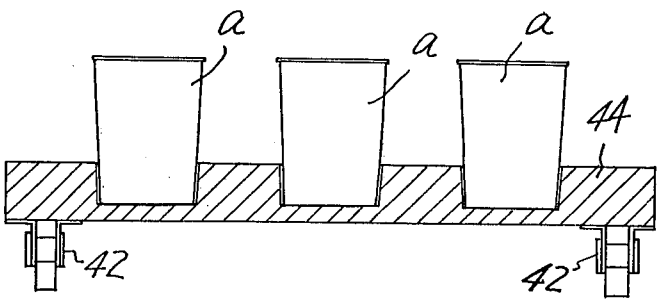
Figure 12:
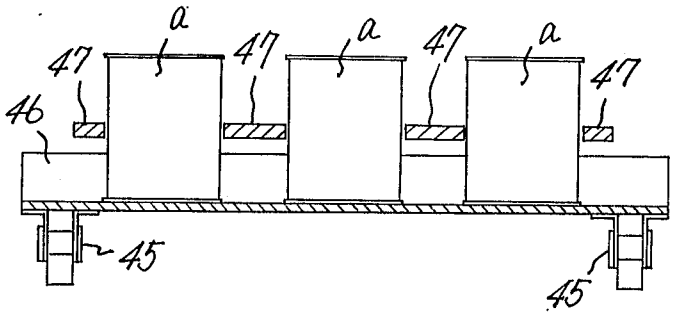
Figure 11:
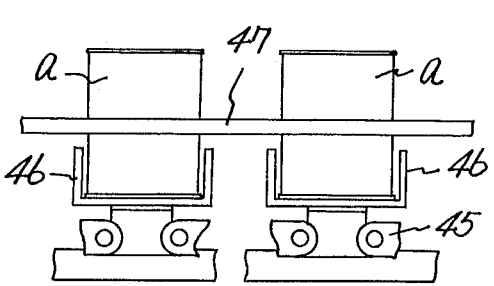
Figure 13:
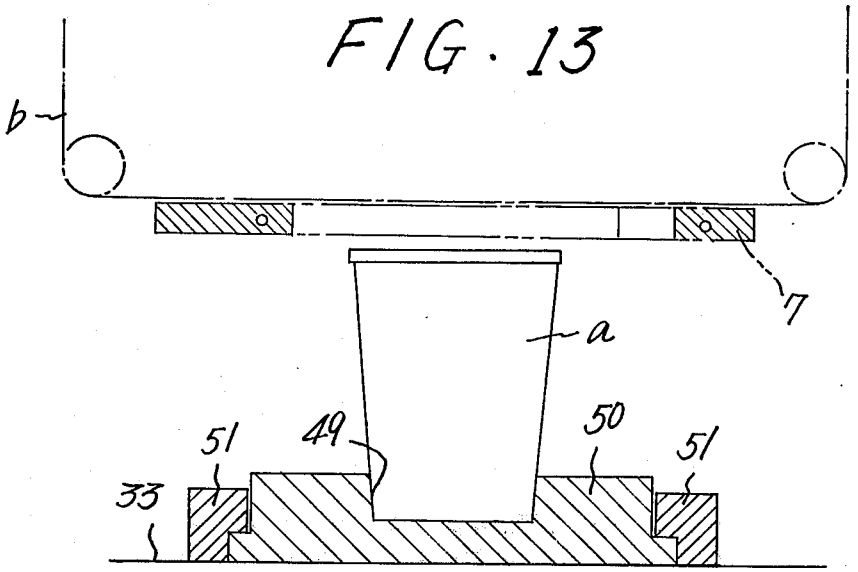

FIG. 3*a* is a front view showing the head portion during operation immediately before the head forces out hot compressed air;

FIG. 4 is an elevation in vertical section showing an annular punch included in the head shown in FIG. 3;

FIG. 5 is a view taken along the line V—V in FIG. 4;

FIG. 6 is a view in section taken along the line VI—VI in FIG. 5;

FIG. 7 is a front view of the same embodiment except that it employs a different container feeder;

FIG. 8 is a plan view of the container feeder of FIG. 7;

FIG. 9 is a front view showing another modification of the container feeder;

FIG. 10 is a side elevation in vertical section of the container feeder shown in FIG. 9;

FIG. 11 is a front view showing another modification of the container feeder;

FIG. 12 is a side elevation in vertical section of the container feeder shown in FIG. 11;

FIG. 13 is an elevation in vertical section showing an example of manual container feeder according to this invention.

Means 1 for cutting out sealing sheets comprises an annular metal punch 2 mounted on the outer side of the hot air outlet member 25 to be described below and positioned concentrically therewith and a stationary die 3 coacting with the punch 2 (see FIG. 3). The annular punch 2 has such an annular shape that it cuts out from a continuous film *b* sealing sheets S in a shape having predetermined dimensions and substantially similar to the shape of the head *a'* of the container *a* to be sealed as the head is seen in plan. As will be apparent from FIG. 4, the punch 2 has a blade 2*a* comprising a plurality of inverted V-shaped edges arranged throughout the entire circumference of the punch and each having an equal circumferential length. The edges of the blade are serrated. When desired, the punch 2 has a portion 4 outwardly bulging from part of the blade 2*a* and U-shaped in plan (see FIGS. 4 and 5). Indicated at 57 in FIG. 5 is the part of the blade 2 having no cutting edge due to the formation of the bulging portion 4. The sealing sheet S cut out from the film *b* by such punch has on its periphery a tongue-like projection which can be utilized as a pull tab to facilitate the removal of the sheet from the sealed head of the container *a*. The bulging portion 4 is of course edged along the periphery of its lower end. The edge of the portion 4 is formed along the outer periphery of lower end of a block 56 fixed to the punch 2.

A clamp 5 for the film includes a vertically movable upper clamping member 6 mounted on the lower ends of vertical rods 8 and a stationary lower clamping member 7 fixed to the lower ends of columns 9. When desired, the upper member 6 and/or lower member 7 may be formed with a passage 20 for passing a cooling medium such as air or water. The vertical rods 8 are slidably supported by a plate 12 fixed to the lower end of a rod 11 connected to a vertical shank 10 to be driven by a fluid pressure such as air or liquid pressure. Each of the vertical rods 8 has a stopper head 8*a* at its upper end. Slide shoes 13 connected to the plate 12 by unillustrated suitable means and movable with the plate 12 fit around the columns 9. Coiled springs 14 are provided between the slide shoes 13 and the upper clamping member 6. The coiled springs 14 are in a neutral state while the plate 12 and the shoes 13 are not in their lowered position.

A holder 15 for the sealing sheets S has a block 17 fixed to the lower ends of rods 16 slidably suspended from the plate 12 in the same manner as the rods 8. When seen in plan, the block 17 is similar to and slightly larger than the head *a'* of the container *a*. The block 17 is formed with a passage 18 for passing air, water or like medium for cooling the block 17. The passage 18 is in communication with an inlet passage 19 and an outlet passage 21 for the cooling medium. To simplify the construction, the rods 16 are hollow to provide the passages 19 and 21 in their interior. The block 17 is formed with a space 22 for introducing hot air thereinto to temporarily heat the block 17 and to thereby slightly heat the portion of the sealing sheet in contact with the lower surface of the block 17 to such an extent that the sheet will be kept taut. Preferably, the block 17 may include at its lower portion a member 17*a* made of rubber or like elastic material so as to render the block 17 amenable to contact with the sealing sheet S.

Means 23 for folding the sealing sheet comprises a portion projecting downward from the periphery of the lower portion of the block 17. Alternatively, the lower end of the member 25 defining the hot air outlet 24 to be described below any serve as the sheet folding means 23.

The outlet 24 is annular, horizontal and concentric with the block 17 and serves as the means for applying hot air. The member 25 is annular and is fitted around the block 17 with a clearance formed therebetween and has a lower end defining the outlet 24. The member 25 is fixed to the plate 12 and has a space 27 communicating with the outlet 24 through ports 26 only (one of the ports being shown in figures) and an electric heater 28 for heating the air within the space 27. Compressed air is supplied to the space 27 from an air source (not shown) through a control valve (not shown) and a passageway 29 extending through the rod 11. A coiled compression spring 30 is provided between the upper face of the block 17 and the surface of the member 25 opposite thereto. The member 25 has a thermocoupled 31 electrically connected to the heater 28 for the on-off control of the heater 28 to maintain the member 25 and accordingly the air within the space 27 at a predetermined temperature. In place of the on-off control unit provided with the thermocouple a thermostat is employable for the temperature control of the member 25. To ensure safety a fuse (not shown) may be used, thereby enabling to preclude the possible accident due to overheating.

A plate 32 fixed to the upper ends of the columns 9 is in combination with a support 52 (see FIG. 3) slidably transversely of the apparatus and is set in position on the support 52 by set screws (not shown). The support 52 is secured to a block 35 (see FIG. 2) which is slidable on a guide post 34 (see FIG. 2) mounted on the frame 33 of the apparatus. A pneumatic cylinder 36 (see FIGS. 1 and 2) for operating the vertical shank 10 is mounted on the support 52. For the adjustment of position, the block 35 is vertically movable by adjusting screw 37 (see FIGS. 2), whereby the head A of the apparatus including the cutting-out means, clamp, holder, folding means and hot air applying means is vertically shiftable for the adjustment of its position in accordance with the height of the container *a* to be sealed. One head A may be usable as illustrated, or a plurality of like heads A may be arranged transversely of the frame 33.

The plate 32 on the upper ends of the columns 9 is removable from the support 52 when the set screws therefor are removed. The rod 11 connected to the shank 10 by means 53 (see FIG. 3) is also separable from the shank 10 in the same manner as in the combination of the plate 32 and support 52.

The illustrated apparatus of this invention operates as follows. The continuous film *b* wound on a beam 38 is fed out, by a specified length, to a position below the head A of feed rollers 39 (see FIG. 1), whereupon the rollers 39 are halted. The duration of operation of the rollers 39, namely withdrawal of the specified length of the film *b* may be controlled by suitable known means.

Figure 1:
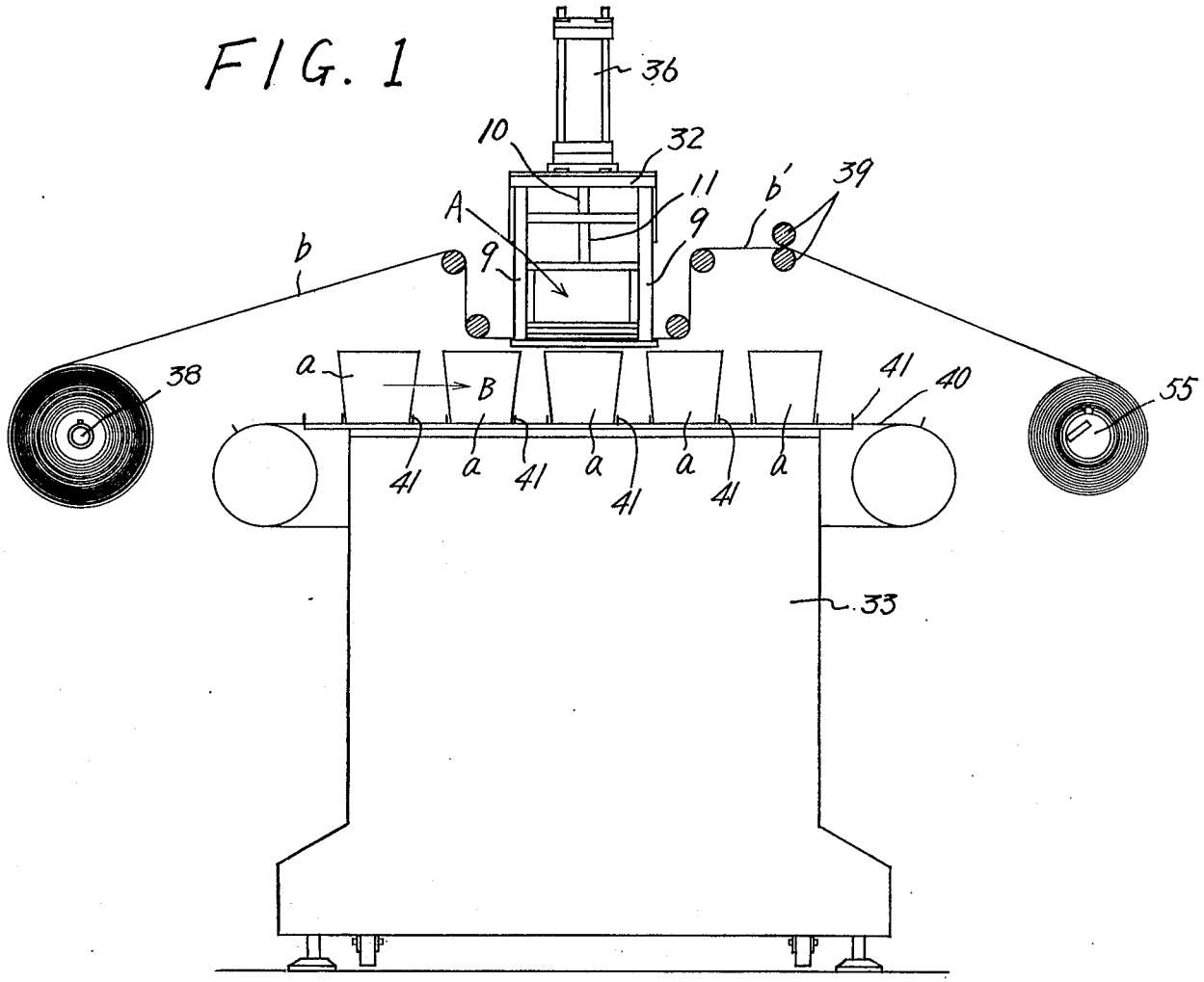
FIG. 1 is a front view schematically showing an embodiment of this invention in its entirety.
Figure 2:
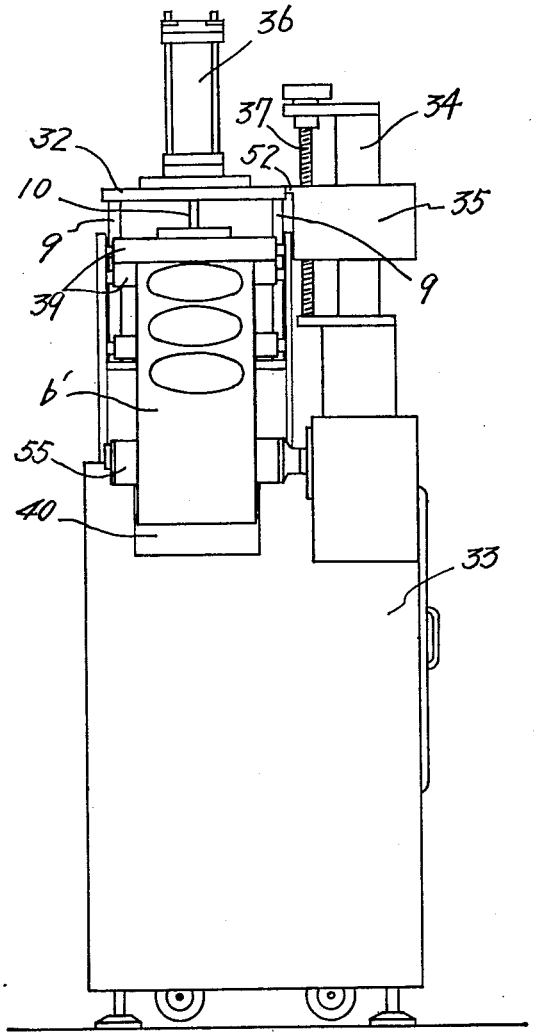
FIG. 2 is a side elevation of the apparatus shown in FIG. 1.

The containers *a* to be sealed are retained by supporting members 41 attached to a belt conveyor 40 at a regular spacing and are advanced in the direction of arrow B in FIG. 1. When the container *a* is brought to the position immediately below the head A, the conveyor 40 is stopped. The operation of the conveyor 40 may be controlled by suitable known means. Alternatively, the container feeder may comprise a turntable 54 in which cavities (not shown) for receiving the containers *a* in position are formed at a regular spacing (see FIGS. 7 and 8). The turntable 54 is rotatable through a predetermined angle and then halted under the control of suitable known means. In place of these feeders, also usuable is a chain conveyor 42 provided with a plate 44 formed with apertures 43 for receiving the containers *a* (see FIGS. 9 and 10). Another type of feeder comprises a chain conveyor 45 provided with buckets 46 for receiving the containers *a* (see FIGS. 11 and 12). Indicated at 47 in FIGS. 11 and 12 are guide rails provided along the path of travel of the containers *a* and fixed to the frame of the apparatus. The feeder shown in FIGS. 9 and 10 and the feeder shown in FIGS. 11 and 12 are adapted for use with a plurality of heads A arranged side by side transversely of the apparatus, in which case the heads A are positioned in corresponding relation to the rows of containers *a* on the conveyor. Still another type of the feeder comprises a slidable plate 50 formed in its upper surface with cavities 49 for receiving the containers *a* (see FIG. 13). The plate 50 is manually movable along parallel stationary guide rails 51. The plate is adapted to be brought to position by suitable known means.

When the container *a* has been brought to the specified position on the apparatus, the working fluid is introduced into the cylinder 36 to lower the shank 10, which in turn causes the rod 11 to drive the plate 12 downward, thereby lowering the rods 8 and the upper clamping member 6. The plate 12 continues to descend even after the clamping member 6 comes into contact with the film, which then gets in touch with the stationary lower clamping member 7. Consequently, the slide shoes 13 descending with the plate 12 force down the upper clamping member 6 through the springs 14, with the result that the film *b* is clamped between the member 6 and lower clamping member 7. Thereafter, the plate 12 still continues to descend, causing the member 25 to lower the annular punch 2, which in turn coacts with the die 3 to cut out a sealing sheet S of the predetermined shape from the film *b.* Since the annular punch 2 has been heated with the heat of the member 25 given by the heater 28, the sealing sheet S is cut off also by being melted. The cut-out sheet S falls onto the head *a'* of the underlying container *a.*

On the other hand, as the plate 12 descends, the rods 16 and, therefore, the block 17 also descend. After the bottom surface of the lower member 17*a* of the block 17 has come into contact with the sealing sheet S on the head *a'* of the container *a,* the member 25 continues to descend with the plate 12, causing the spring 30 to depress the block 17, with the result that the member 17*a* of the block 17 presses the sealing sheet against the head *a'* of the container *a* (see FIG. 3*a*). The peripheral portion S' of the sealing sheet pressed against the container head *a'* and covered with the member 17*a* projects outward from the container head *a'* by a predetermined dimension. The projecting peripheral portion S' is folded toward the outer peripheral surface of the container head *a'* by the folding means 23.

When the outlet 24 has been brought to the same level as the peripheral portion S' of the sealing sheet as the plate 12 and, therefore, the member 25 further descend, namely when the pulse 12 has reached the lowest position, the unillustrated valve of compressed air source is opened to supply compressed air through the passageway 29 to the space 27, from which the hot air is led through the ports 26 to the outlet 24 and then against the peripheral portion S' of the sealing sheet. Consequently, the peripheral portion S' of the sheet is shrunk by the heat to seal the head of the container *a* in the form of a cap. In order to force out the hot air from the outlet 24 against the peripheral portion S' in the form of a swirling stream and to thereby heat-shrink the peripheral portion S' effectively, the axis of the port 26 may preferably be inclined with respect to the axis of the annular member 25, namely of the outlet 24.

It is not desirable that the vertical width of the outlet 24 be much greater than the width of the peripheral portion S' of the sealing sheet S projecting from the container head *a',* since the peripheral portion S' will then curl upward. Preferably the vertical width of the outlet 24 may be equal to, or slightly greater than, the width of projection of the sealing sheet.

During the foregoing operation, the clamp 5 and holder 15 are preferably cooled with the cooling medium flowing through the passages 18 and 20 therein.

After the completion of the sealing operation, the shank 10 is returned upward to the original position. While the outlet 24 opposes the inlet 22*a* of the space 22 of the holder 15 at the initial stage of the return, the hot air is forced out for some time from the outlet 24 through the inlet 22*a* into the space 22 to heat the block 17. Accordingly, the heat is given to the sealing sheet in contact with the bottom surface of the block 17 to slightly shrink the sheet and to thereby eliminate a slack. The duration of such additional heating varies widely with the set temperature of the heater 28, the quality of the film used, etc. Good results are attainable with heating for a very short period of time usually, for example, for 0.1 to 0.5 second. After the application of hot air for the above-mentioned additional heating has been completed, the block 17 is cooled again by the cooling medium flowing through the passages 19, 18 and 21.

Upon the return of the head A to the original position, the sealed container is removed and a container to be sealed is fed to the specified position. The apparatus is thereafter brought into operation in the same manner as above to repeat the sealing cycle.

The film scrap *b'* remaining after the sealing sheets S have been cut out is wound up onto a take-up reel 55.

Although this invention has been described above with reference to several preferred embodiments for illustrative purposes only, the invention is not limited to the embodiments. Various modifications will be apparent to those skilled in the art.

What we claim is:

1. Apparatus for sealing the heads of containers with heat shrinkable film comprising:

means defining a sealing location;

means for positioning containers to be sealed at their sealing location:

means for intermittently feeding a continuous film of heat shrinkable material past said sealing location above a container located thereat;

cutter means disposed at said sealing location above a container positioned thereat and including a vertically movable angular punch, said punch being sized and configured to cut from said heat shrinkable film individual portions thereof each forming a sealing sheet having a shape generally similar to the shape in plan view of said container head to be sealed but being larger in size than said container head so that when placed over a container head said sealing sheets will include an overhang portion extending beyond the periphery of said container head which will hang over along a portion of the side of said container;

means for clamping said heat shrinkable film along portions thereof surrounding said portion forming said sealing sheet, said clamped portions being, prior to cutting of said sealing sheets, contiguous with said portion of said heat shrinkable film which form said sealing sheets, said clamping means including a vertically movable upper member and a stationary lower member located to have said film passed therebetween by said feeding means and to clamp said film therebetween during cutting of said sealing sheets, said upper and lower members of said clamping means being arranged to extend about said vertically movable annular punch in close proximity thereto thereby to act as a die member for said punch when said punch is actuated to cut said sealing sheets from said film;

holding means positioned over the head of said containers placed at said sealing location and movable downwardly into engagement with said container heads to press said sealing sheets against said head after said sealing sheets have been cut from said film;

means operatively associated with said holding means to fold said sealing sheets along the periphery of said container head to urge said overhand portions of said sealing sheets to extend downwardly along a portion of the sides of said containers;

means for applying hot air against said molded overhang portions of said sealing sheets to heat seal said sheets upon said container heads; and cooling means physically joined with said clamping means and extending therewith in proximity to the portions of said clamping means which engage said heat shrinkable film portions during cutting-out of said sealing portions therefrom, said cooling means removing from said clamping means heat energy, particularly heat energy received from said hot air applying means, in order to maintain the temperature of said clamping means at a level sufficiently low to avoid deleterious shrinkage of said portions of said film clamped in said clamping means.

2. Apparatus according to claim 1 wherein said cooling means comprise passages defined internally of said clamping means and adapted to have a fluid cooling medium pass therethrough.

3. Apparatus according to claim 1 further including means for temporarily heating said holding means to thereby heat-shrink the portion of said sealing sheet in contact with the holding means to such an extent that the portion will be rendered free of any slack, and means for cooling said holding means.

4. Apparatus according to claim 1 wherein said means to hold said sealing sheets are formed about the periphery of the lower portion of said holding means and constitute a downwardly extending annular wall encircling said container head and having a length which extends over only a very small portion of said overhang portion of said sealing sheets.

5. Apparatus according to claim 1 wherein said annular punch is formed to include an outwardly bulging portion for forming a tongue-like tab on the periphery of said sealing sheets.

6. Apparatus according to claim 1 which is formed to include a plurality of individual assemblies, each of said assemblies having means defining a separate sealing location, said assemblies each having said film or heat shrinkable material intermittently passed therethrough by said means for feeding said film, each of said assemblies including said means for positioning said containers at said sealing location of each individual assembly; said cutter means, said clamping means, said holding means, said means to fold said sealing sheets, said means for applying hot air and said cooling means.

* * * * *